US008334482B2

(12) United States Patent
Nam et al.

(10) Patent No.: US 8,334,482 B2
(45) Date of Patent: Dec. 18, 2012

(54) COOKING RANGE WITH AIR CIRCULATION MECHANISM

(75) Inventors: Hyeun Sik Nam, Seoul (KR); Dong Seong Kwag, Seoul (KR); Wan Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 12/762,397

(22) Filed: Apr. 19, 2010

(65) Prior Publication Data

US 2010/0276412 A1 Nov. 4, 2010

(30) Foreign Application Priority Data

Apr. 30, 2009 (KR) ..... 10-2009-0038097

(51) Int. Cl.
*F27D 5/00* (2006.01)

(52) U.S. Cl. ..... 219/392; 219/452.11

(58) Field of Classification Search ..... 219/392
See application file for complete search history.

(56) References Cited

U.S. PATENT DOCUMENTS 4,601,279 A * 7/1986 Guerin ..... 126/21 A
7,087,862 B1 * 8/2006 Shaffer et al. ..... 219/392
7,856,973 B2 12/2010 Kim et al.
2005/0092746 A1 5/2005 Song et al.
2007/0131220 A1 * 6/2007 Kim et al. ..... 126/273 R

FOREIGN PATENT DOCUMENTS

KR 10-19970007119 A 2/1997
KR 10-0389410 B 6/2003
KR 10-0698204 B1 3/2007

OTHER PUBLICATIONS

PCT International Search Report dated Jan. 24, 2011 for Application No. PCT/KR2010/002759, 3 pages.

* cited by examiner

*Primary Examiner* — Julio J Maldonado
*Assistant Examiner* — Robert Bachner
(74) *Attorney, Agent, or Firm* — Fish & Richardson P.C.

(57) ABSTRACT

A cooking range is disclosed. The range includes: a cook top section having a heating body configured to cook foods; an oven section having internal walls defining a cavity, a rack and a door, wherein the cavity is configured to accommodate the foods placed on the rack and the door is configured to open or close the cavity; a heating source configured to provide heat to the cavity when the cooking range is operated; and an air circulation mechanism having an exhaust slot and at least one suction slot and configured to suck air into the cooking range through the at least one suction slot and to discharge the air to the outside through the exhaust slot, wherein the at least one suction slot is positioned around the exhaust slot.

17 Claims, 4 Drawing Sheets

COOKING RANGE WITH AIR CIRCULATION MECHANISM

CROSS-REFERENCE TO RELATED APPLICATION

The present application is claims benefits of priority to Korean Application Number 10-2009-0038097, filed on Apr. 30, 2009, which is herein expressly incorporated by reference in its entirety.

FIELD

The present disclosure relates to an cooking range.

BACKGROUND

A cooking range includes an oven section indirectly heating foods by using a high temperature heat air in a space, and a cook-top section directly heating the foods, where the oven section and the cook-top section are combined in a single unit.

The cooking range may be categorized into three types based on the types of heat sources, that are an electric oven range adopting an electric heater as a heat source, a microwave oven equipped with a magnetron which heats the foods via penetration of microwaves generated from a super high frequency oscillator into the foods and a gas oven using flames from a gas fuel burner for heating the foods. Likewise, the cooking range may be categorized based on types of heat sources of the cook top section.

A conventional cooking ranges includes a cavity that is heated for cooking foods. The cavity is opened or closed by a door that is moveable to provide access to the cavity that is in turn horizontally defined with racks. The racks are moveable toward the door along a guide rail formed inside the cavity. The cook top section is defined with a controller for indicating a user menu and controlling an entire operation of the cooking range.

The oven section has multiple operation modes. For example, in a self cleaning mode, a locally-overheated hot spot is generated by a high heat transmitted to surrounding of the cavity because the self cleaning mode for removing odor or wastes from an inside of the cavity requires heating the inside of the cavity at a relatively high temperature, that mode may decrease the life of the range and cause safety hazards thereof.

There is another disadvantage in that a controller at the cook top section may be erroneously operated, and in case of a built-in type cooking range, there is a fear of damaging the kitchen furniture located around the cooking range.

SUMMARY

In one aspect, a cooking range: a cook top section having a heating body configured to cook foods; an oven section having internal walls defining a cavity, a rack and a door, wherein the cavity is configured to accommodate the foods placed on the rack and the door is configured to open or close the cavity; a heating source configured to provide heat to the cavity when the cooking range is operated; and an air circulation mechanism having an exhaust slot and at least one suction slot and configured to suck air into the cooking range through the at least one suction slot and to discharge the air to the outside through the exhaust slot, wherein the at least one suction slot is positioned around the exhaust slot.

In another aspect, a cooking range includes: a cook top section having a heating body configured to cook foods; an oven section having internal walls defining a cavity, a rack and a door, wherein the cavity is configured to accommodate the foods placed on the rack and the door is configured to open or close the cavity; a heating source configured to provide heat to the cavity when the cooking range is operated; and an air circulation mechanism having an exhaust slot, an exhaust duct, at least one suction slot, and a suction duct, configured to circulate air provided from the at least one suction slot to the suction duct and the exhaust duct, and discharge the circulated air to outside through the exhaust slot, wherein the at least one suction slot is positioned around the exhaust slot.

In yet another aspect, a cooking range includes: a cook top section having a heating body configured to cook foods; an oven section having internal walls defining a cavity, a rack and a door, wherein the cavity is configured to accommodate the foods placed on the rack and the door is configured to open or close the cavity; a heating source configured to provide heat to the cavity when the cooking range is operated; and an air circulation means having an exhaust slot and at least one suction slot that are positioned on a front surface of the cooking range and configured to suck air into the cooking range through the at least one suction slot and to discharge the air to outside through the exhaust slot, wherein the at least one suction slot is positioned around the exhaust slot to reduce a whirly circulation of the air.

DETAILED DESCRIPTION

The cooking range may be categorized into two types based on installation that are a free standing type and a built-in type. The free standing type is configured for independent positioned and moved relates to kitchen cabinet and furniture with side covers being exposed to the outside. The built-in type positioned between the side cover and the kitchen furniture. In this implementation, a built-in type cooking range may not require installation of the side covers.

In some implementations, the cooking range may include a hybrid type that is capable of being used as a built-in type as well as a free standing type based on whether the cooking range is installed inside the kitchen furniture.

Figure 1:
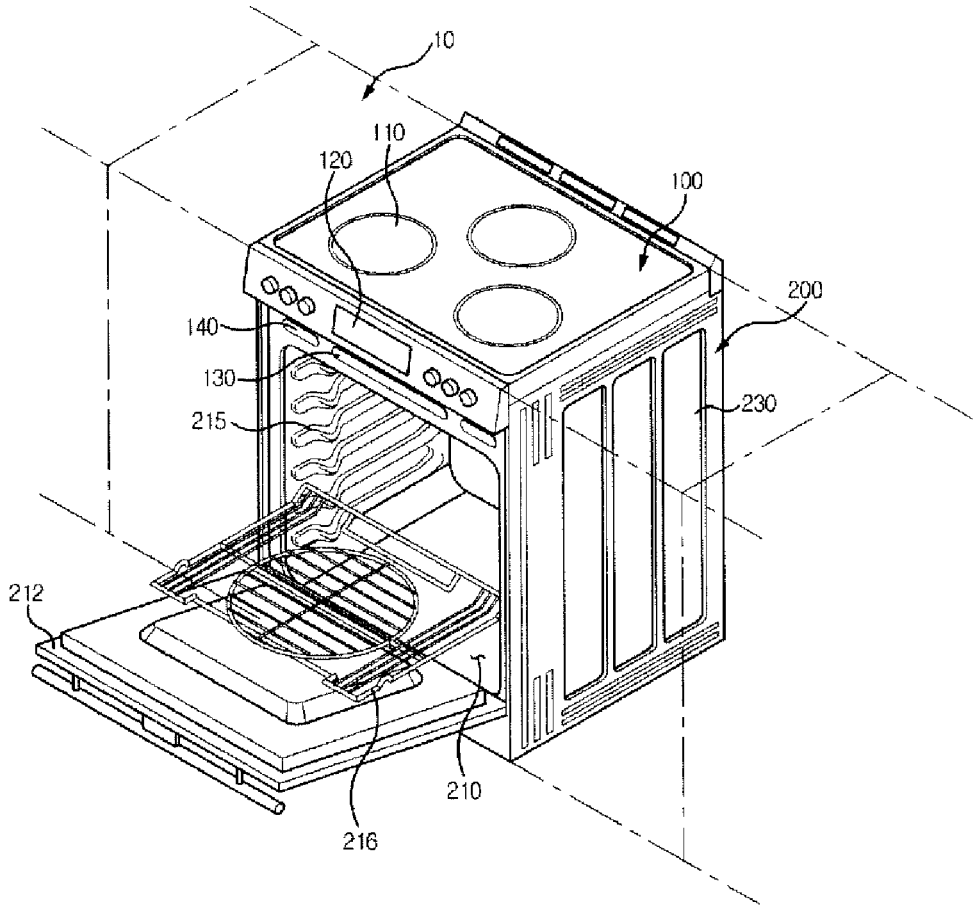
FIG. 1 is a view of a cooking range.

Referring to FIG. 1, a cooking range includes an oven section 200 indirectly heating foods such as cakes, breads and barbecues by using a high temperature heat air in a space, and a cook-top section 100 positioned at an upper side of the oven section 200 directly heating the foods.

A heat source heating the oven section 200 may be, for example, an electric heater, a microwave, a gas flame or the like. The oven section 200 may include a cavity 210, a door 212 and side covers 230.

The cavity 210 having a space for cooking foods is opened or closed by the door 212, and is mounted therein with a rack 216 on which foods are placed. For example, the cavity 210 is to be coated with enamel or other coating material to easily clean an interior of the cavity. The rack 216 is moveably supported along a guide member 215 positioned inside the cavity 210 toward the door 212.

The rack 216 allows the foods to be put into the cavity 210 for cooking or to be taken out from the cavity 210 when the cooking of the foods are done. Each of the side covers 230 defines an exterior view of the cooking range. Insulation material 240 may be interposed between the side cover 230 and the cavity 210 to reduce or prevent heat from the cavity 210 to be transmitted to ambience of the cooking range.

The cook top section 100 has a heating body 110 for cooking foods. The heating body 110 may include any heating source, such as a gas burner, an electric burner, a ceramic heater, a microwave or the like.

The cook top section 100 also may have a controller 120 for displaying a user menu and controlling an entire operation of the cooking range. For example, the controller 120 performs control functions such as detecting an internal temperature of the cavity 210 and the cooked condition of the foods, and controlling the oven section 200 lest the foods should be burnt or over-cooked.

The controller 120 may also display various menus and operation status on a display unit so that a user can select a desired menu therefrom. The controller 120 may further perform control functions such as residual heat display function that displays residual heat, reservation function, timer function and self cleaning function that automatically cleans an interior of the cavity 210. The controller 120 includes a microprocessor that is mount on a printed circuit board (PCB).

Further, if heat is concentrated on a portion of the cooking range, for example, near the controller 120 which is sensitive to static electricity or heat may be erroneously operated or damaged. Particularly, the cavity 210 may rise to a high temperature during performance of self cleaning function to stand out the heat concentration.

In addition, if the cooking range is the built-in type, the cooking range installed in a tightly-sealed space of the kitchen furniture 10 may decrease the cooling efficiency and may be needed to stand out the heat concentration phenomenon, whereby the kitchen furniture 10 positioned around the cooking range may be overheated (e.g., 90° C. or more) when the cooking range is operated.

The overheating phenomenon may be reduced by using the insulation material 240 that wraps an upper side and lateral surfaces of the cavity 210. Further, an air circulation system that circulates the heat to an exterior may reduce the heat transmitted to a portion of the cooking range such as side covers 230 adjacent to the kitchen furniture 10 or the controller 120.

In addition, since the cooking range is a hybrid type capable of being used in a built-in type as well as a free standing type, the controller 120 may be installed at an upper side of the oven section 200 or a front surface of the cook top section 100.

In some examples, the air circulation system has a structure capable of circulating the air to reduce the heat concentrated on the upper front surface of the oven section 200 on which the controller 120 is mounted. In the description, the front direction refers to a direction facing the door 212, and the rear direction refers a direction facing a rear wall positioned inside the cavity 210.

Figure 2:
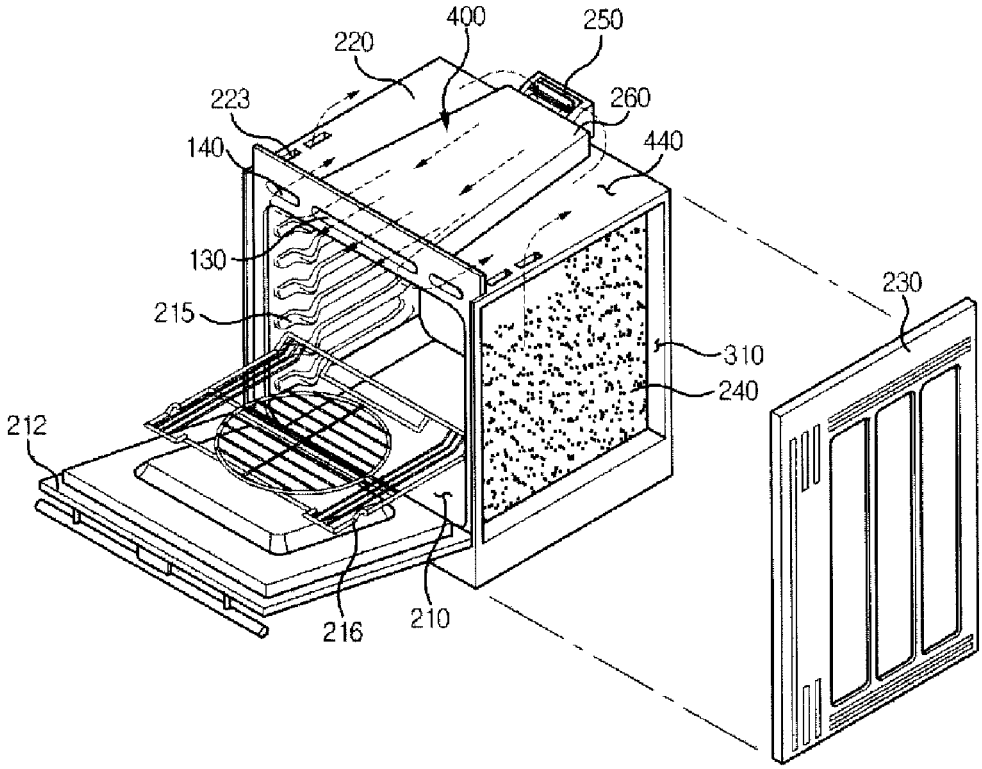
FIG. 2 is a view illustrating a structure of a cooking range.

Referring to FIG. 2, the air circulation system may include an exhaust slot 130 discharging an ambient heat of the cavity 210 to the exterior or outside and a suction slot 140, sucking the heated air which is located around the exhaust slot 130. In some implementations, the air circulation system may further include at least one a cooling fan 250 generating wind to circulate the heated air in the cooing range.

Figure 3:
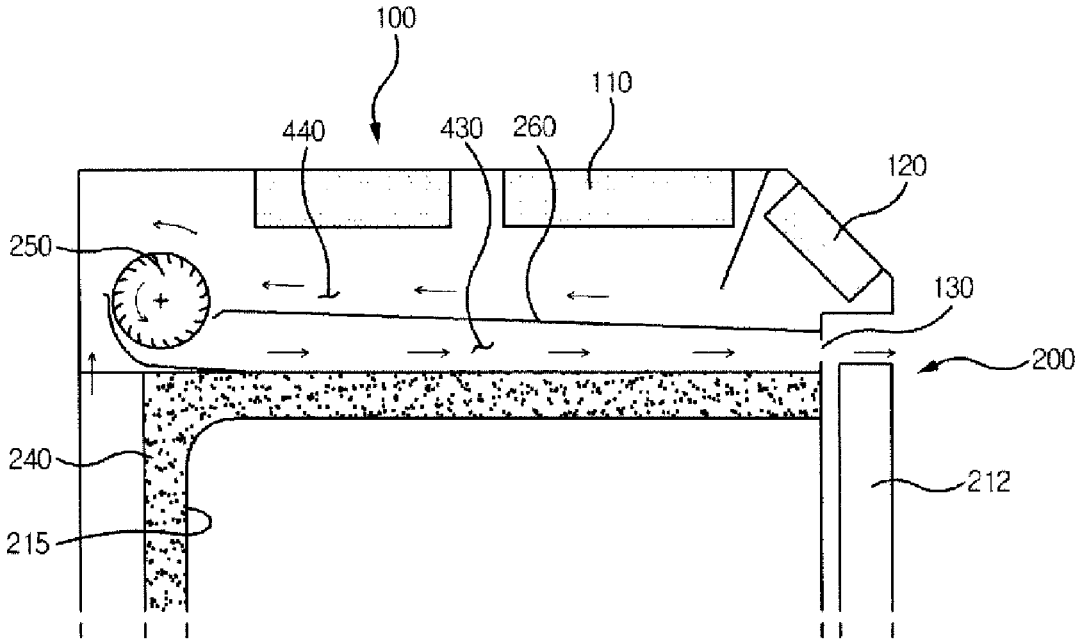
FIG. 3 is a view illustrating an air circulation of a cooking range.

Referring to FIG. 3, the exhaust duct 430 is configured to provide an exhaust path which is an empty space inside of a duct member 260. The duct member 260 is positioned at an upper side of the cavity 210 and provides an air path. The air path is connecting the cooling fan 250 with the exhaust slot 130.

Referring to FIGS. 2 and 3, the suction duct 440, which is an empty space corresponding to an external space of the duct member 260, provides an air circulation path connecting the suction slot 140 with the cooling fan 250. For example, air is provided through the suction slot 140 to the suction duct 440 and then the air is supplied to the exhaustion duct 430 based on rotation of the cooling fan 250. In this implementation, air from the cook top section 100, the side cover 230 or an outside surface of the duct member 260 also supplied to the exhaustion duct 430.

As shown in FIG. 2, the exhaust slot 130 and the suction slot 140 are positioned between the cook top section 100 and the oven section 200. Two suction slots 140 are defined outside of the exhaust slot 130. The heat may be concentrated on an upper front part of the side cover 230. In this implementation, the heat around the exhaust slot 130 where the heat may be concentrated is sucked through the suction slot 140, the suction duct 440 and the cooling fan 250 and discharged to the outside through the exhaust duct 430 and the exhaust slot 130.

In some examples, the hot air, swirling at the distal end of the exhaust slot 130, is blocked by a door switch arranged between the cook top section 100 and the oven section 200 for detecting the openness of the door 212. Also, an upper side of the door 212, a bottom surface of the cook top section and side cover 230 causes a surrounding at the upper side of the door 212 to overheat.

The stagnant hot air is removed by being sucked into the oven section 200 via the suction slot 140. The hot air sucked into the oven section 200 is again discharged via the exhaust duct 430, whereby temperature at outer surface of the oven section 200 (e.g., the upper part where the heat is concentrated) may not be increased due to the circulation means.

Although not shown in the drawings, the controller 120 may detect whether there is any heat concentration around the oven section 200 by using a temperature sensors positioned at the cover 230, an interior of the cavity 210 or the upper side of the cavity 210, and control the rotation speed or rotation direction of the cooling fan 250 based on the detected temperature, whereby the particular region of cooking range is not overheated.

Further, an upper surface slot 223 is able to further facilitate circulation the air from outside of the cavity 210. The upper surface slot 223 may be positioned at both corners of an upper surface panel 220 covering an upper side of the cavity 210 and becomes an input/output path of air defined in a space inside of the side cover 230. The upper surface slot 223 may communicate the suction duct 440 with a duct located at a lateral surface of the cavity 210. In a case an insulation material 240 is installed at the lateral surface of the cavity 210, the hot air locked up between the insulation material 240 and the side cover 230 is provided to the suction duct 440 through the upper surface slot 223.

For example, the upper surface slot 223 is located at a front surface of both corners of the upper surface panel 220, because the air circulation is focused on the front surface in order to concentratively cool the upper front surface of the oven section 200 and around the controller 120.

Figure 4:
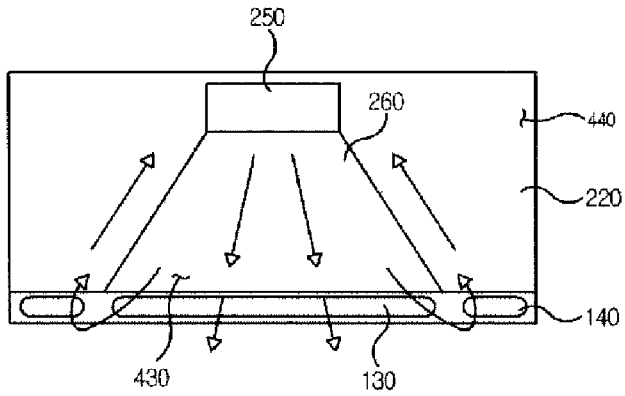
FIG. 4 is a view illustrating an air circulation of a cooking range.

FIGS. 3 and 4 also illustrate an air flow path. The hot air around the cavity 210 is discharged to the outside through the cooling fan 250, the exhaust duct 430 includes the duct member 260 and the exhaust slot 130, and the hot air stagnant at the surrounding of the exhaust slot 130 is sucked through the suction slot 140 and provided to the suction duct 440 and the cooling fan 250.

The sucked air is discharged again to the outside through the exhaust duct 430 and the exhaust slot 130, whereby a hot spot that is overheated by the heat swirling around the exhaust slot 130 is not generated or at least reduced. In this implementation, the exhaust duct 430 is arranged underneath the controller 120 to reduce the heat transmission to the controller 120.

Figure 5:
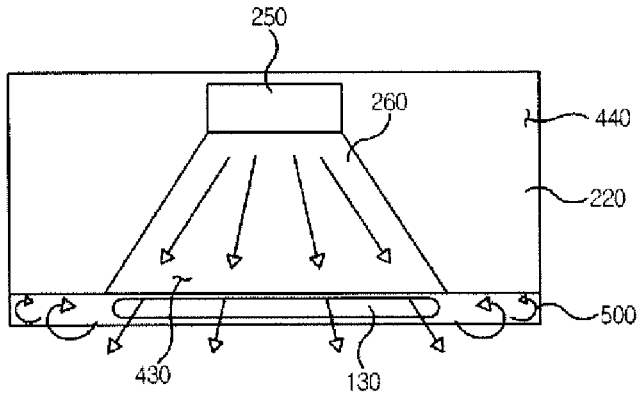
FIG. 5 is a view illustrating an air circulation of a cooking range.

Referring to FIG. 5, in case that a suction slot 140 is not defined in the front surface of the cooking range, a reference number 500 shows a hot air stagnant at the ambience of the exhaust slot 130.

Figure 6:
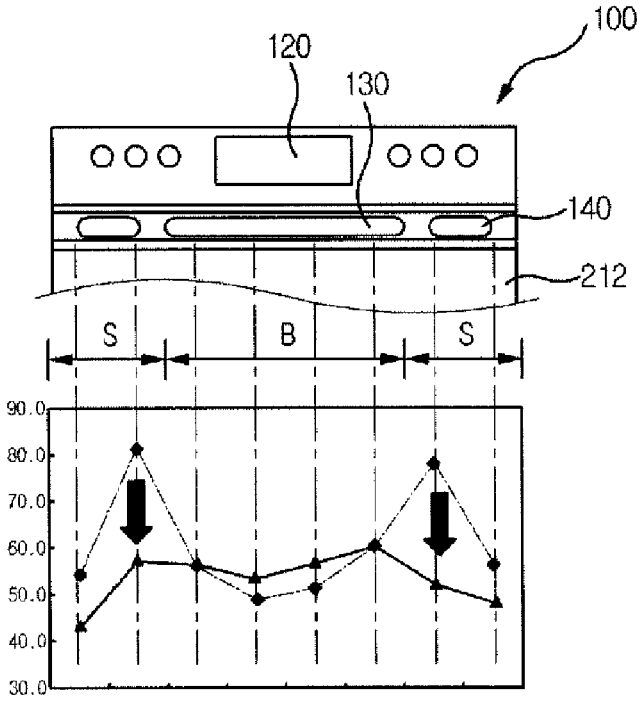
FIG. 6 is a graph illustrating a temperature-decreased effect.

FIG. 6 shows a temperature-decreased effect if a suction slot 140 is located around the exhaust slot 130. In this implementation, a horizontal axis defines a temperature measurement position, a vertical axis is a measured temperature, a black lozenge indicates a temperature value in a case the suction slot 140 is not installed, and a black triangle shows a temperature value in a case the suction slot 140 is installed.

Referring to FIG. 6, in a region (B) where the heat is discharged through the exhaust slot 130, there is no big temperature difference between before and after the suction slot 140 is installed. But, in a region (S), the temperature is drastically decreased when the suction slot 140 is installed.

Referring to the graph in FIG. 6, in case that the suction slot 140 is installed, a temperature decrease as approximately 24° C. can be observed at the left side of the exhaust slot 130, and a temperature decrease as approximately 26° C. can be observed at the right side of the exhaust slot 130.

Swirling hot air stagnant at an upper side of door and an upper front surface of the side cover is sucked into the suction duct through the suction slot and discharged through the exhaust slot, such that an overheating at a region of the cooking range such as near the controller, the upper front surface of the side cover, the upper side of the door, a bottom surface of the cook top section or an ambience of the exhaust slot can be reduced.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A cooking range comprising:

a cook top section having a heating body configured to cook foods;

an oven section having internal walls defining a cavity, a rack and a door, wherein the cavity is configured to accommodate the foods placed on the rack and the door is configured to open or close the cavity;

a heating source configured to provide heat to the cavity when the cooking range is operated; and an air circulation mechanism having an exhaust slot and at least one suction slot and configured to suck air into the cooking range through the at least one suction slot and to discharge the air to the outside through the exhaust slot, wherein the at least one suction slot is positioned around the exhaust slot, wherein the suction slot positioned between the exhaust slot and a side cover.

2. The cooking range of claim 1, wherein the exhaust slot and the suction slot are positioned on the front surface of the cooking range and below the cook top section.

3. The cooking range of claim 1, wherein a plurality of suction slots are positioned at both sides of the exhaust slot and configured to guide the heat which is stagnant around the exhaust slot.

4. The cooking range of claim 1, wherein the circulation mechanism further comprises a fan configured to promote an air circulation path.

5. The cooking range of claim 4, wherein the circulation mechanism further comprises an exhaust duct positioned on the cavity and configured to discharge the air from the fan to the exhaust slot based on rotation of the fan.

6. The cooking range of claim 4, wherein the circulation mechanism further comprises a suction duct configured to connect the exhaust slot and the fan.

7. The cooking range of claim 1, wherein hot air stagnant at the surrounding of the exhaust slot is sucked through the suction slot.

8. The cooking range of claim 1, wherein the air circulation mechanism further comprises an exhaust duck and a suction duct, wherein the air is inputted to the suction duck through the at least one suction slot and the air is discharged to the outside through the exhaust duct and the exhaust slot.

9. The cooking range of claim 1, further comprising:

a controller positioned on the cook top section, wherein the exhaust duct is arranged underneath the controller.

10. The cooking range of claim 1, wherein the air circulation mechanism further comprises an upper surface slot positioned at both corners of an upper surface panel covering an upper side of the cavity.

11. The cooking range of claim 6, wherein the air circulation mechanism further comprises an upper surface slot configured to communicate a space located at a lateral surface of the cavity and the suction duct.

12. The cooking range of claim 1, wherein two or more suction slots positioned between the exhaust slot and a plurality of side covers, wherein at least one suction slot is positioned between the exhaust slot and each of side covers.

13. A cooking range comprising:

a cook top section having a heating body configured to cook foods;

an oven section having internal walls defining a cavity, a rack and a door, wherein the cavity is configured to accommodate the foods placed on the rack and the door is configured to open or close the cavity;

a heating source configured to provide heat to the cavity when the cooking range is operated; and an air circulation mechanism having an exhaust slot, an exhaust duct, at least one suction slot, and a suction duct, configured to circulate air provided from the at least one suction slot to the suction duct and the exhaust duct, and discharge the circulated air to outside through the exhaust slot, wherein the at least one suction slot is positioned around the exhaust slot, wherein the suction slot positioned between the exhaust slot and a side cover.

14. The cooking range of claim 13, wherein a plurality of suction slots are positioned at both sides of the exhaust slot and configured to guide the heat which is stagnant around the exhaust slot.

15. The cooking range of claim 13, wherein the circulation mechanism further comprises a fan configured to promote an air circulation path.

16. The cooking range of claim 13, wherein the air circulation mechanism further comprises an upper surface slot positioned at both corners of an upper surface panel covering an upper side of the cavity.

17. The cooking range of claim 13, wherein two or more suction slots positioned between the exhaust slot and a plurality of side covers, wherein at least one suction slot is positioned between the exhaust slot and each of side covers.

* * * * *